US011436971B2

(12) United States Patent
Kim et al.

(10) Patent No.: US 11,436,971 B2
(45) Date of Patent: Sep. 6, 2022

(54) DISPLAY DRIVING APPARATUS WITH VERTICAL TWO DOT POLARITY INVERSION

(71) Applicant: Silicon Works Co., Ltd., Daejeon (KR)

(72) Inventors: Yong Min Kim, Daejeon (KR); Ju Ho Lee, Daejeon (KR); Da Sol Won, Daejeon (KR); Se Hyuk An, Daejeon (KR)

(73) Assignee: Silicon Works Co., Ltd, Daejeon (KR)

( * ) Notice: Subject to any disclaimer, the term of this patent is extended or adjusted under 35 U.S.C. 154(b) by 0 days.

(21) Appl. No.: 17/126,443

(22) Filed: Dec. 18, 2020

(65) Prior Publication Data

US 2021/0201756 A1 Jul. 1, 2021

(30) Foreign Application Priority Data

Dec. 27, 2019 (KR) ..... 10-2019-0176088

(51) Int. Cl.
*G09G 3/20* (2006.01)

(52) U.S. Cl.
CPC ... *G09G 3/2092* (2013.01); *G09G 2300/0413* (2013.01); *G09G 2310/0254* (2013.01); *G09G 2310/0275* (2013.01); *G09G 2310/0297* (2013.01)

(58) Field of Classification Search
CPC ..... G09G 3/20; G09G 3/2092; G09G 3/2096; G09G 3/3611; G09G 3/3614; G09G 3/3685; G09G 3/3688; G09G 2300/0413; G09G 2310/0254; G09G 2310/0275; G09G 2310/0297; G09G 2354/00; G09G 2370/10; G09G 2370/14; G06F 3/0416; G06F 3/04166
See application file for complete search history.

(56) References Cited

U.S. PATENT DOCUMENTS

2008/0170025 A1* 7/2008 Song ..... G09G 3/3688 345/96
2016/0370915 A1* 12/2016 Agarwal ..... G06F 3/0443
2018/0335888 A1* 11/2018 Endo ..... G06F 3/04166
2019/0385504 A1* 12/2019 Jeong ..... G09G 5/008

FOREIGN PATENT DOCUMENTS

KR 2017-0020684 A 2/2017
KR 2018-0079555 A 7/2018
KR 2019-0027674 A 3/2019
KR 2019-0058995 A 5/2019
KR 2020-0029834 A 3/2020

* cited by examiner

*Primary Examiner* — Keith L Crawley
(74) *Attorney, Agent, or Firm* — Polsinelli PC

(57) ABSTRACT

A display driving apparatus includes an output control circuit configured to, with one frame being divided into a plurality of blank periods by touch driving, output source signals corresponding to display data during the plurality of blank periods; and a polarity control circuit configured to receive pre-polarity control information for polarity inversion, and control polarities of the source signals outputted from the output control circuit, for polarity inversion by the unit of vertical 2 dots for one frame, wherein polarities for pre dummy lines and active data lines of odd-numbered and even-numbered blank periods are controlled by the pre-polarity control information.

16 Claims, 2 Drawing Sheets

Fig. 3

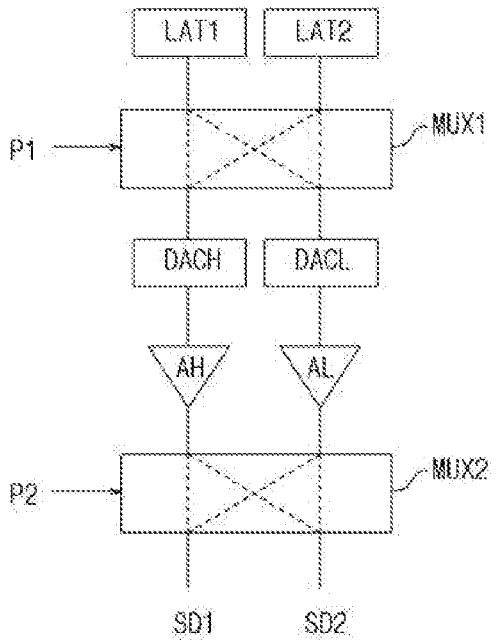

Fig. 4

| | | LHB1(Odd) | | | LHB2(Even) | | | LHB3(Odd) | | | LHB4(Even) | | |
|---|---|---|---|---|---|---|---|---|---|---|---|---|---|
| Pre-Polarity Control | | LL/LH | HL | HH | LL/LH | HL | HH | LL/LH | HL | HH | LL/LH | HL | HH |
| Pre Dummy Lines | P01 | − | + | + | + | + | + | + | − | − | − | − | − |
| | P02 | − | + | − | + | + | − | + | − | + | − | − | + |
| Active DATA Line | 1 | + | + | + | + | − | − | − | − | − | − | + | + |
| | 2 | + | + | + | − | + | + | − | | − | + | | − |
| | 3 | − | − | − | − | + | + | + | + | + | + | − | − |
| | 4 | − | − | − | + | − | − | + | + | + | − | + | + |
| | 5 | + | + | + | + | − | − | − | − | − | − | + | + |
| | 6 | + | + | + | − | + | + | − | − | − | + | − | − |
| | 7 | − | − | − | − | + | + | + | + | + | + | − | − |
| | 8 | − | − | − | + | − | − | + | + | + | − | + | + |
| | ⋮ | ⋮ | ⋮ | ⋮ | ⋮ | ⋮ | ⋮ | ⋮ | ⋮ | ⋮ | ⋮ | ⋮ | ⋮ |
| | 129 | + | + | + | + | − | − | − | − | − | − | + | + |
| | 130 | + | + | + | − | + | + | − | − | − | + | − | − |
| | 131 | − | − | − | − | + | + | + | + | + | + | − | − |
| | 132 | − | − | − | + | − | − | + | + | + | − | + | + |
| | 133 | + | + | + | + | − | − | − | − | − | − | + | + |
| | 134 | + | + | + | − | + | + | − | − | − | + | − | − |
| | 135 | − | − | − | − | + | + | + | + | + | + | − | − |

DISPLAY DRIVING APPARATUS WITH VERTICAL TWO DOT POLARITY INVERSION

BACKGROUND

1. Technical Field

Various embodiments generally relate to a display driving apparatus, and more particularly, to a display driving apparatus for improving a horizontal line defect.

2. Related Art

A display apparatus may be developed to provide a display function and a touch function for a display panel, depending on a use thereof.

When having the touch function, the display apparatus may be configured to perform touch driving for the display panel by the unit of a frame or perform touch driving for the display panel several times in one frame.

In the case where touch driving is performed several times in one frame, one frame may be divided into a plurality of blank periods by the unit of touch driving. For example, one frame may be divided into 16 blank periods. The blank period may be defined as a long horizontal blank period, and hereinafter, is abbreviated as an LHB period.

By the above description, the display apparatus is operated to repeat output of source signals for an LHB to the display panel and touch driving of the display panel, during one frame.

For instance, in the case where the display panel is configured to perform a touch and a display in an in-cell scheme, a pixel has a structure in which an electrode is shared for the touch and the display.

For example, a common electrode may be shared for the touch and the display. However, a level of a voltage applied to the common electrode for the display and a level of a voltage applied to the common electrode for the touch are set differently.

Since there is a difference between voltage environment for touch driving and voltage environment for displaying, the display apparatus needs to be stabilized to voltage environment for outputting source signals for the displaying, when entering an LHB period after the touch driving.

The display apparatus may be configured to perform polarity inversion by the unit of vertical 2 dots in order to improve the quality of an image by the physical characteristic of a pixel. Therefore, active data lines in one frame should be driven by the polarity inversion by the unit of vertical 2 dots. The polarity inversion by the unit of vertical 2 dots means controlling polarities of source signals to be inverted by the unit of two vertically adjacent horizontal lines.

However, in the case where an odd number of active data lines are included in an LHB period, it is difficult for a last active data line of a previous LHB period and a first active data line of a current LHB period to maintain the polarity inversion by the unit of vertical 2 dots.

For the reasons set forth above, a horizontal line may be generated by the unit of an LHB period, in the screen of one frame to be displayed.

Therefore, a display driving apparatus needs to be improved in order to solve an image issue raised by a horizontal line defect described above.

SUMMARY

Various embodiments are directed to a display driving apparatus for improving a horizontal line defect that occurs at the time of entry into an LHB period after touch driving in a frame performing polarity inversion by the unit of vertical 2 dots.

In an embodiment, a display driving apparatus may include: an output control circuit configured to, with one frame being divided into a plurality of blank periods by touch driving, output source signals corresponding to display data during the plurality of blank periods; and a polarity control circuit configured to receive pre-polarity control information for polarity inversion, and control polarities of the source signals outputted from the output control circuit, for polarity inversion by the unit of vertical 2 dots for one frame, wherein each blank period includes a first pre dummy line, a second pre dummy line and a plurality of active data lines which are successive, wherein the output control circuit maintains the display data latched during a previous blank period in the first pre dummy line and the second pre dummy line, and wherein the polarity control circuit inverts, by the pre-polarity control information, polarities designated for polarity inversion, by the unit of vertical 2 dots, of the source signals for the first pre dummy line and the second pre dummy line of an odd-numbered blank period and the plurality of active data lines of an even-numbered blank period.

In an embodiment, a display driving apparatus may include: an output control circuit configured to, with one frame being divided into a plurality of blank periods by touch driving, output source signals corresponding to display data during the plurality of blank periods; and a polarity control circuit configured to receive pre-polarity control information for polarity inversion, and control polarities of the source signals outputted from the output control circuit, for polarity inversion by the unit of vertical 2 dots for one frame, wherein each blank period includes a first pre dummy line, a second pre dummy line and a plurality of active data lines which are successive, wherein the output control circuit maintains display data latched during a previous blank period in the first pre dummy line and the second pre dummy line, and wherein the polarity control circuit inverts, by the pre-polarity control information, polarities designated for polarity inversion, by the unit of vertical 2 dots, of the source signals for the first pre dummy line of an odd-numbered blank period and the second pre dummy line and the plurality of active data lines of an even-numbered blank period.

In an embodiment, a display driving apparatus may include: a timing controller configured to provide a data packet including control data including polarity information and display data; and a driving circuit configured to restore the display data and the polarity information from the data packet, and output source signals which correspond to the display data and whose polarities are controlled by the polarity information, wherein the polarity information includes normal polarity control information for polarity inversion by the unit of vertical 2 dots for one frame and pre-polarity control information for inverting polarities designated by the normal polarity control information, wherein one frame is divided into a plurality of blank periods by touch driving, wherein each blank period sequentially includes at least one pre dummy line and a plurality of active data lines, and wherein the driving circuit inverts, by the pre-polarity control information, polarities, designated by the normal polarity control information, of the source signals for the at least one pre dummy line of an odd-numbered blank period and the plurality of active data lines of an even-numbered blank period.

The display driving apparatus according to the embodiments of the disclosure may control the polarities of pre dummy lines or active data lines of an odd-numbered LHB period and an even-numbered LHB period by pre-polarity control information in a frame in which polarity inversion is implemented by the unit of vertical 2 dots.

As a result, at the time of entry into an LHB period from a touch driving period in one frame, the voltage environment may be stabilized by controlling the polarity of a pre dummy line, and polarity inversion by the unit of vertical 2 dots between LHB periods may be maintained by controlling the polarity of an even-numbered active data line.

Therefore, the display driving apparatus according to the embodiments of the disclosure may solve a horizontal line defect that occurs at the time of entry into an LHB period from a touch driving period in the case where a frame is displayed through polarity inversion by the unit of vertical 2 dots.

BRIEF DESCRIPTION OF THE DRAWINGS

FIG. 3 is a detailed circuit diagram of an output control circuit.

FIG. 4 is a table to assist in the explanation of polarity inversion in accordance with the embodiment of the disclosure.

DETAILED DESCRIPTION

A display driving apparatus in accordance with an embodiment of the disclosure performs touch driving a multitude of times while displaying the screen of one frame. An embodiment of the display driving apparatus for this may be configured as illustrated in FIG. 1.

Figure 1:
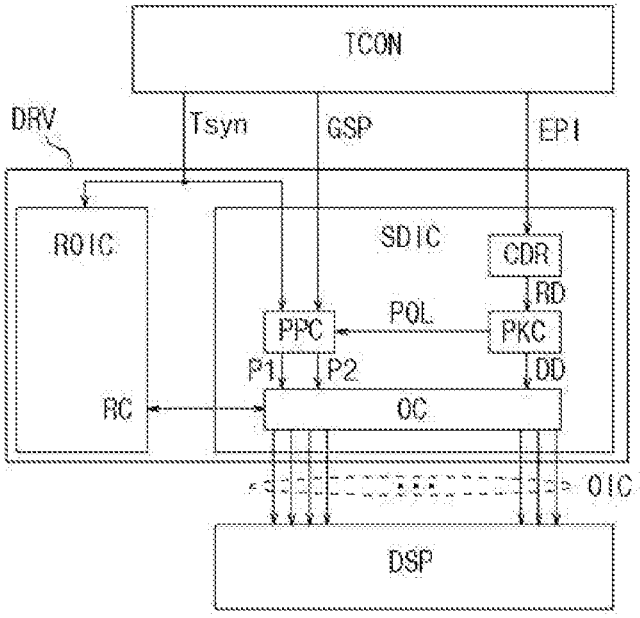
FIG. 1 is a block diagram illustrating a display driving apparatus in accordance with an embodiment of the disclosure.

Referring to FIG. 1, the embodiment of the display driving apparatus in accordance with the disclosure includes a timing controller TCON and a driving circuit DRV.

The timing controller TCON is configured to provide a data packet EPI, which includes control data, including polarity information, and display data, to the driving circuit DRV. The polarity information includes normal polarity control information and pre-polarity control information, and detailed description thereof will be made later.

The timing controller TCON may be configured to provide additional signals such as a touch control signal Tsyn and a frame start signal GSP to the driving circuit DRV through separate signal lines, separately from the data packet EPI.

The touch control signal Tsyn is to distinguish a touch driving period and a display driving period, and the frame start signal GSP is to synchronize a point of time at which each frame is started.

The timing controller TCON may receive the display data from an outside, and may store the normal polarity control information and the pre-polarity control information as the polarity information in a storage space therein.

The timing controller TCON may include various information, such as the polarity information, in the control data, and may combine the normal polarity control information and the pre-polarity control information at a preset position of a bit stream forming the control data.

The timing controller TCON may be arranged in a predetermined format so as to serially output the display data and the control data, and as a result, may output the data packet EPI, which is generated, through a data transmission line. For example, the data transmission line may be configured to transmit the data packet EPI in a differential signal transmission scheme.

Figure 2:
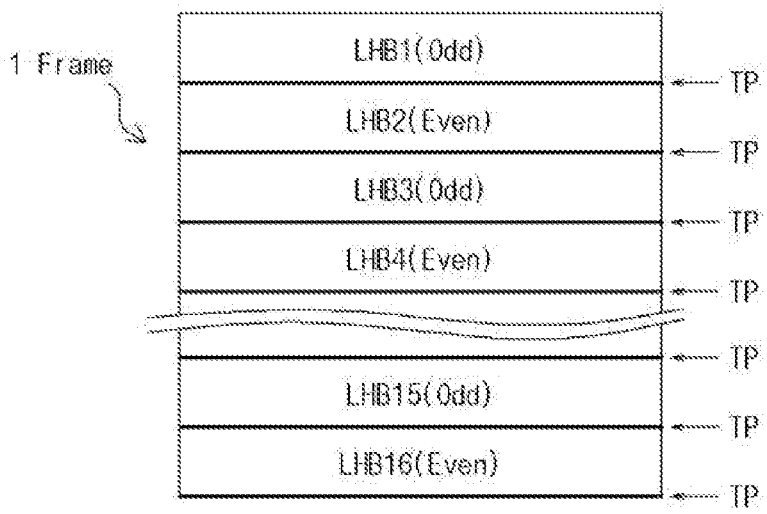
FIG. 2 is a diagram illustrating that one frame is divided into a plurality of LHB periods by touch driving periods.

In the present disclosure, one frame is divided into a plurality of blank periods (hereinafter, referred to as "LHB periods") by a plurality of touch driving periods TP, as illustrated in FIG. 2. The divided blank periods are denoted by LHB1, LHB2, . . . . LHB16, and the present disclosure illustrates, as an example, that one frame is divided into 16 LHB periods. LHB1, LHB3, . . . , LHB15 correspond to odd-numbered LHB periods, and LHB2, LHB4, . . . , LHB16 correspond to even-numbered LHB periods.

Each LHB period may be understood as a display driving period.

Although not illustrated in detail in FIG. 2, each LHB period may sequentially include at least one pre dummy line and a plurality of active data lines. The pre dummy line and the plurality of active data lines may be understood with reference to FIG. 4. FIG. 4 is a table illustrating the configuration of one LHB period and a polarity control state for each pre-polarity control information, and illustrates that two pre dummy lines PD1 and PD2 and an odd number of active data lines, that is, 135 active data lines 1, 2, . . . , 135 are included in one LHB period.

Among them, the pre dummy lines PD1 and PD2 are to drive source signals before driving source signals by the plurality of active data lines, and are located at the beginning of the LHB period. By driving the source signals for the pre dummy lines PD1 and PD2, the voltage environment of a display driving circuit SDIC, which will be described later, may be preliminarily converted from environment for touch driving before the LHB period into environment for display driving. That is to say, the pre dummy lines PD1 and PD2 are to stabilize, for display driving, the voltage environment of the display driving circuit SDIC before driving the source signals of the plurality of active data lines. The source signals by the pre dummy lines PD1 and PD2 are not displayed on a display panel DSP.

The plurality of active data lines are to display a screen of the LHB period on the display panel DSP.

The normal polarity control information is information which designates polarities of pre dummy lines and a plurality of active data lines, for polarity inversion by the unit of vertical 2 dots for a frame. The polarity inversion by the unit of vertical 2 dots means controlling polarity inversion by the unit of 2 adjacent horizontal lines, that is, 2 adjacent active data lines, in a frame.

The pre-polarity control information in accordance with the present disclosure is to solve a horizontal line defect that occurs at points of time of entry into LHB periods when polarity inversion is performed by the unit of vertical 2 dots for one frame. In detail, the pre-polarity control information is information for solving a horizontal line defect that occurs at the beginning of an LHB period, by inverting polarities designated by the normal polarity control information.

The pre-polarity control information may be set to invert polarities, designated by the normal polarity control information, of source signals for at least one pre dummy line of an odd-numbered LHB period and a plurality of active data lines of an even-numbered LHB period.

In detail, in the case where two pre dummy lines are configured, the pre-polarity control information may be set to invert polarities, designated by the normal polarity control information, of source signals for two pre dummy lines of an odd-numbered LHB period and a plurality of active data lines of an even-numbered LHB period. Unlike this, in the case where two pre dummy lines are configured, the pre-polarity control information may be set to invert, polarities designated by the normal polarity control information, of source signals for a first pre dummy line of an odd-numbered LHB period and a second pre dummy line and a plurality of active data lines of an even-numbered LHB period.

The normal polarity control information and the pre-polarity control information described above may be set such that all frames included in the data packet EPI have the same values.

For reference, a switching control signal P1 of FIG. 1 may be controlled by the pre-polarity control information, and a switching control signal P2 of FIG. 1 may be controlled by the normal polarity control information.

The driving circuit DRV is configured to receive the data packet EPI through the data transmission line and receive the touch control signal Tsyn and the frame start signal GSP through the separate signal lines.

The driving circuit DRV may include a touch driving circuit ROIC for touch driving and the display driving circuit SDIC for display driving.

The touch driving circuit ROIC is configured to receive the touch control signal Tsyn, recognize the touch driving period TP by the touch control signal Tsyn, and provide a pulse type touch driving signal to the display panel DSP and receive a touch sensing signal which is read out, during the touch driving period TP.

The touch driving circuit ROIC may provide the touch driving signal and receive the read-out touch sensing signal through an output control circuit OC of the display driving circuit SDIC.

An interface between the touch driving circuit ROIC and the display driving circuit SDIC for this is schematically illustrated in FIG. 1. A terminal RC of the touch driving circuit ROIC may be understood as representatively illustrating terminals for providing touch driving signals and receiving touch sensing signals. A connection line between the output control circuit OC of the display driving circuit SDIC and the terminal RC of the touch driving circuit ROIC may be understood as schematically illustrating the providing of the touch driving signals and the reception of the touch sensing signals, of the touch driving circuit ROIC.

The display driving circuit SDIC is configured to receive the touch control signal Tsyn, the frame start signal GSP and the data packet EPI, and is configured to be connected to the display panel DSP through signal lines OIC. The signal lines OIC may be understood as being configured to output the source signals of the output control circuit OC or the touch driving signals of the touch driving circuit ROIC or to receive the touch sensing signals of the display panel DSP.

The display driving circuit SDIC is configured to restore display data and polarity information from the data packet EPI and output source signals, which correspond to the display data and whose polarities are controlled by the polarity information, through the signal lines OIC.

To this end, the display driving circuit SDIC is configured to include a restoration circuit CDR, a data control unit PKC, a polarity control circuit PPC, and the output control circuit OC.

The restoration circuit CDR is configured to receive the data packet EPI and provide restoration data RD, obtained by restoring the display data and the polarity information of the data packet EPI, to the data control unit PKC.

The data control unit PKC is configured to separate polarity information POL including pre-polarity control information and normal polarity control information and display data DD from the restoration data RD, provide the polarity information POL to the polarity control circuit PPC, and provide the display data DD to the output control circuit OC.

The polarity control circuit PPC is configured to receive the touch control signal Tsyn, the frame start signal GSP and the polarity information POL, and provide the switching control signal P1 having a level corresponding to the pre-polarity control information and the switching control signal P2 having a level corresponding to the normal polarity control information, to the output control circuit OC.

The polarity control circuit PPC provides the switching control signal P1 for inverting the polarities of source signals designated by the normal polarity control information, and provides the switching control signal P2 for controlling the polarities of source signals so as to perform polarity inversion by the unit of vertical 2 dots for a frame.

The polarity control circuit PPC is configured to provide the switching control signals P1 and P2 to the output control circuit OC when the frame start signal GSP is enabled and the touch control signal Tsyn has a value corresponding to a display driving period.

The output control circuit OC is configured to receive display data, maintain display data latched during a previous LHB period in correspondence to at least one pre dummy line, and output source signals corresponding to the display data during a plurality of LHB periods.

The polarities of source signals outputted from the output control circuit OC may be controlled by the switching control signals P1 and P2 of the polarity control circuit PPC.

For example, the output control circuit OC may output source signals for at least one pre dummy line of an odd-numbered LHB period and a plurality of active data lines of an even-numbered LHB period such that polarities designated by the normal polarity control information have polarities inverted by the pre-polarity control information, and may output source signals for remaining pre dummy lines and plurality of active data lines to have polarities designated by the normal polarity control information.

Controlling the polarities of source signals by the pre-polarity control information and the normal polarity control information in the output control circuit OC described above may be described with reference to FIG. 3.

Referring to FIG. 3, the output control circuit OC may include latches LAT1 and LAT2, a switching circuit MUX1, digital-analog converters DACH and DACL, output buffers AH and AL, and a switching circuit MUX2.

The latches LAT1 and LAT2 are configured to latch display data corresponding to respective pixels of a pre dummy line or an active data line. The latches LAT1 and LAT2 maintain the latched display data of a last active data line of a previous LHB period in correspondence to pre dummy lines. The latches LAT1 and LAT2 may update display data corresponding to active data lines by the unit of each active data line.

The switching circuit MUX1 may be configured by a multiplexer, and may output data, latched in the latch LAT1, to the digital-analog converter DACH or the digital-analog converter DACL by the switching control signal P1 provided by the pre-polarity control information.

Also, the switching circuit MUX1 may output data, latched in the latch LAT2, to the digital-analog converter DACH or the digital-analog converter DACL by the switching control signal P1.

In other words, the switching circuit MUX1 is configured to transfer display data through direct paths or cross paths between the latches LAT1 and LAT2 and the digital-analog converters DACH and DACL.

The digital-analog converters DACH and DACL are configured to output analog signals having gray scales corresponding to inputted display data. In detail, the digital-analog converter DACH outputs an analog signal having a gray scale corresponding to display data for conversion into a positive polarity, and the digital-analog converter DACL outputs an analog signal having a gray scale corresponding to display data for conversion into a negative polarity.

The output buffer AH is operated by a driving voltage having a positive polarity, and is configured to output a source signal by driving an analog signal of the digital-analog converter DACH to have a positive polarity.

The output buffer AL is operated by a driving voltage having a negative polarity, and is configured to output a source signal by driving an analog signal of the digital-analog converter DACL to have a negative polarity.

The switching circuit MUX2 may be configured by a multiplexer, and is configured to output a source signal of the output buffer AH through a channel SD1 or output a source signal of the output buffer AL through a channel SD2, by the switching control signal P2 provided by the normal polarity control information.

Further, the switching circuit MUX2 is configured to output a source signal of the output buffer AL through the channel SD1 or output a source signal of the output buffer AH through the channel SD2, by the switching control signal P2.

Namely, the switching circuit MUX2 is configured to transfer source signals through direct paths or cross paths between the output buffers AH and AL and the channels SD1 and SD2.

First, in the case where the pre-polarity control information has a value deactivating the switching control signal P1 so as not to consider a horizontal line defect, the switching circuit MUX1 transfers display data of the latches LAT1 and LAT2 through the direct paths. That is to say, the display data of the latch LAT1 is converted into an analog signal by the digital-analog converter DACH, and the display data of the latch LAT2 is converted into an analog signal by the digital-analog converter DACL.

In this case, polarity inversion of source signals by the pre-polarity control information does not occur.

Therefore, when the pre-polarity control information has a value deactivating the switching control signal P1, polarity inversion of source signals is controlled by the switching circuit MUX2.

In other words, source signals outputted to the channels SD1 and SD2 are determined by the switching control signal P2 corresponding to the normal polarity control information. This case corresponds to a case where the pre-polarity control information of FIG. 4 is set to "LL/LH."

The case where the pre-polarity control information is set to "LL/LH" and thus the polarities of source signals are controlled by only the normal polarity control information will be described below with reference to FIGS. 3 and 4.

In each LHB period in which the pre-polarity control information corresponds to "LL/LH," polarity inversion by the unit of vertical 2 dots is maintained for all active data lines, by the normal polarity control information. At this time, the pre dummy line may be neglected, or may be set to have a polarity opposite to that of a last active data line of a previous LHB period.

In the case where the pre-polarity control information is "LL/LH," polarity inversion by the unit of vertical 2 dots is not maintained between a last active data line 134 of an LHB1 period as an odd-numbered LHB period and a first active data line 1 of an LHB2 period as an even-numbered LHB period, and also, polarity inversion by the unit of vertical 2 dots is not maintained between a last active data line 134 of the LHB2 period as an even-numbered LHB period and a first active data line 1 of an LHB3 period as an odd-numbered LHB period. Namely, polarity inversion by the unit of vertical 2 dots is not maintained at the beginning of each LHB period. Therefore, a horizontal line defect may occur at the beginning of each LHB period.

In the embodiment of the present disclosure, a horizontal line defect may be solved by the switching control signal P1 corresponding to the pre-polarity control information. The switching circuit MUX1 transfers display data of the latches LAT1 and LAT2 through direct paths or cross paths by the switching control signal P1. That is to say, the switching circuit MUX1 forms the direct paths when maintaining polarities by the normal polarity control information, and forms the cross paths when inverting polarities by the normal polarity control information.

In this case, polarity inversion occurs twice in the process of outputting display data as source signals. First polarity inversion occurs in the case where cross paths for transfer of display data are formed between the latches LAT1 and LAT2 and the digital-analog converters DACH and DACL by the pre-polarity control information, and second polarity inversion occurs in the case where cross paths for output of source signals are formed between the output buffers AH and AL and the channels SD1 and SD2 by the normal polarity control information. As a result, the case where polarity inversion occurs twice as described above may be understood as the case where polarities designated by the normal polarity control information are inverted by the pre-polarity control information.

This case corresponds to a case where the pre-polarity control information of FIG. 4 is set to "HL" or "HH."

First, a case where the pre-polarity control information is set to "HL" and thus the polarities of source signals are controlled by the pre-polarity control information and the normal polarity control information will be described below with reference to FIGS. 3 and 4.

In this case, in the LHB1 period as an odd-numbered LHB period, source signals for the pre dummy lines PD1 and PD2 have inverted polarities (+, +) as compared to the case where the pre-polarity control information is "LL/LH," and the source signals of the active data line 1 to the active data line 135 have the same polarities as compared to the case where the pre-polarity control information is "LL/LH." As a result, polarity inversion by the unit of vertical 2 dots is maintained. At this time, the source signal of the last active data line 135 of the LHB1 period has a negative (−) polarity.

It may be understood that, in the LHB1 period described above, as the switching circuit MUX1 provides cross paths by the pre-polarity control information, source signals for the pre dummy lines PD1 and PD2 have inverted polarities as compared to the case where the pre-polarity control information is "LL/LH." Further, it may be understood that, in the LHB1 period described above, as the switching circuit MUX1 provides direct paths by the pre-polarity control information, the source signals of the active data line 1 to the active data line 135 have the same polarities as compared to the case where the pre-polarity control information is "LL/LH."

In the following description, the cases where pre dummy lines and active data lines have inverted polarities and the same polarities as compared to the case where the pre-polarity control information is "LL/LH" may be understood from the above description.

In the LHB2 period, as an even-numbered LHB period, successive to the LHB1 period, source signals for the pre dummy lines PD1 and PD2 maintain the same polarities as compared to the case where the pre-polarity control information is "LL/LH," and the source signals of the active data line 1 to the active data line 135 have opposite polarities as compared to the case where the pre-polarity control information is "LL/LH." As a result, polarity inversion by the unit of vertical 2 dots is maintained.

At this time, the first active data line 1 of the LHB2 period has the same polarity (−) as the last active data line 135 of the LHB1 period. Therefore, polarity inversion by the unit of vertical 2 dots between the odd-numbered LHB1 period and the even-numbered LHB2 period is maintained.

In the LHB3 period, as an odd-numbered LHB period, successive to the LHB2 period, source signals for the pre dummy lines PD1 and PD2 have opposite polarities as compared to the case where the pre-polarity control information is "LL/LH," and the source signals of the active data line 1 to the active data line 135 maintain the same polarities as compared to the case where the pre-polarity control information is "LL/LH." As a result, polarity inversion by the unit of vertical 2 dots is maintained.

Therefore, polarity inversion by the unit of vertical 2 dots between the even-numbered LHB2 period and the odd-numbered LHB3 period is maintained.

In the case where the pre-polarity control information is set to "HL," polarity inversion by the unit of vertical 2 dots is maintained at the beginning of each LHB period, and as a result, it is possible to prevent a horizontal line defect from occurring at the beginning of each LHB period.

Next, a case where the pre-polarity control information is set to "HH" and thus the polarities of source signals are controlled by the pre-polarity control information and the normal polarity control information will also be described below with reference to FIGS. 3 and 4.

In this case, in the LHB1 period as an odd-numbered LHB period, a source signal for the pre dummy line PD1 has an inverted polarity (+) as compared to the case where the pre-polarity control information is "LL/LH," and the source signals of the pre dummy line PD2 and the active data line 1 to the active data line 135 have the same polarities as compared to the case where the pre-polarity control information is "LL/LH." As a result, polarity inversion by the unit of vertical 2 dots is maintained.

In the LHB2 period, as an even-numbered LHB period, successive to the LHB1 period, a source signal for the pre dummy line PD1 maintains the same polarity as compared to the case where the pre-polarity control information is "LL/LH," and the source signals of the pre dummy line PD2 and the active data line 1 to the active data line 135 have opposite polarities as compared to the case where the pre-polarity control information is "LL/LH." As a result, polarity inversion by the unit of vertical 2 dots is maintained.

The first active data line 1 of the LHB2 period has the same polarity (−) as the last active data line 135 of the LHB1 period. Therefore, polarity inversion by the unit of vertical 2 dots between the odd-numbered LHB1 period and the even-numbered LHB2 period is maintained.

In the LHB3 period, as an odd-numbered LHB period, successive to the LHB2 period, a source signal for the pre dummy line PD1 has an opposite polarity as compared to the case where the pre-polarity control information is "LL/LH," and the source signals of the pre dummy line PD2 and the active data line 1 to the active data line 135 maintain the same polarities as compared to the case where the pre-polarity control information is "LL/LH." As a result, polarity inversion by the unit of vertical 2 dots is maintained.

Therefore, polarity inversion by the unit of vertical 2 dots between the even-numbered LHB2 period and the odd-numbered LHB3 period is maintained.

As described above, even in the case where the pre-polarity control information is set to "HH," polarity inversion by the unit of vertical 2 dots is maintained at the beginning of each LHB period, and as a result, it is possible to prevent a horizontal line defect from occurring at the beginning of each LHB period.

In the embodiment of the present disclosure, in the case where the pre-polarity control information is "HL" or "HH," the polarity of at least one of pre dummy lines of an odd-numbered LHB period is changed as compared to the case where the pre-polarity control information is "LL/LH." As a result, polarity inversion may be performed once between a last active data line of a previous LHB period and a current LHB period.

Thus, at the time of entry into an LHB period after a touch driving period, voltage environment may be preliminarily stabilized for display driving, by controlling the polarities of pre dummy lines. Accordingly, the display driving circuit SDIC may drive source signals for active data lines in stable conversion environment under stable voltage environment.

As is apparent from the above description, according to the embodiment of the present disclosure, polarity inversion by the unit of vertical 2 dots between LHB periods may be ceaselessly maintained for an entire frame, and voltage environment for display driving may be quickly stabilized at the beginning of an LHB period after a touch driving period.

Therefore, the display driving apparatus according to the embodiment of the disclosure may solve a horizontal line defect that occurs at the time of entry into an LHB period from a touch driving period in the case where a frame is displayed through polarity inversion by the unit of vertical 2 dots.

What is claimed is:

1. A display driving apparatus comprising:

an output control circuit configured to, with one frame being divided into a plurality of blank periods by touch driving, output source signals corresponding to display data during the plurality of blank periods; and a polarity control circuit configured to receive pre-polarity control information for polarity inversion, and control polarities of the source signals outputted from the output control circuit, for polarity inversion by the unit of vertical 2 dots for one frame, wherein each blank period includes a first pre dummy line, a second pre dummy line and a plurality of active data lines which are successive, wherein the output control circuit maintains the display data latched during a previous blank period in the first pre dummy line and the second pre dummy line, and wherein the polarity control circuit inverts, by the pre-polarity control information, polarities designated for polarity inversion, by the unit of vertical 2 dots, of the source signals for the first pre dummy line and the second pre dummy line of an odd-numbered blank period and the plurality of active data lines of an even-numbered blank period.

2. The display driving apparatus according to claim 1, wherein the plurality of blank periods include the same odd number of active data lines.

3. The display driving apparatus according to claim 1, further comprising:

a restoration circuit configured to restore a data packet which is received, and provide restoration data; and a data control unit configured to separate polarity information including the pre-polarity control information and the display data from the restoration data, provide the polarity information to the polarity control circuit, and provide the display data to the output control circuit.

4. The display driving apparatus according to claim 3, wherein the output control circuit comprises:

a latch configured to latch the display data;

a first digital-analog converter configured to output a first analog signal for the display data for conversion into a positive polarity;

a second digital-analog converter configured to output a second analog signal for the display data for conversion into a negative polarity;

a first switching circuit configured to transfer the display data of the latch to the first digital-analog converter or the second digital-analog converter, by the pre-polarity control information;

a first output buffer configured to output a first source signal of a positive polarity by driving the first analog signal;

a second output buffer configured to output a second source signal of a negative polarity by driving the second analog signal; and a second switching circuit configured to output one of the first source signal and the second source signal as a source signal of a selected channel, by normal polarity control information for polarity inversion by the unit of vertical 2 dots, wherein the pre-polarity control information and the normal polarity control information are received by being included in the polarity information.

5. A display driving apparatus comprising:

an output control circuit configured to, with one frame being divided into a plurality of blank periods by touch driving, output source signals corresponding to display data during the plurality of blank periods; and a polarity control circuit configured to receive pre-polarity control information for polarity inversion, and control polarities of the source signals outputted from the output control circuit, for polarity inversion by the unit of vertical 2 dots for one frame, wherein each blank period includes a first pre dummy line, a second pre dummy line and a plurality of active data lines which are successive, wherein the output control circuit maintains display data latched during a previous blank period in the first pre dummy line and the second pre dummy line, and wherein the polarity control circuit inverts, by the pre-polarity control information, polarities designated for polarity inversion, by the unit of vertical 2 dots, of the source signals for the first pre dummy line of an odd-numbered blank period and the second pre dummy line and the plurality of active data lines of an even-numbered blank period.

6. The display driving apparatus according to claim 5, wherein the plurality of blank periods include the same odd number of active data lines.

7. The display driving apparatus according to claim 5, further comprising:

a restoration circuit configured to restore a data packet which is received, and provide restoration data; and a data control unit configured to separate polarity information including the pre-polarity control information and the display data from the restoration data, provide the polarity information to the polarity control circuit, and provide the display data to the output control circuit.

8. The display driving apparatus according to claim 7, wherein the output control circuit comprises:

a latch configured to latch the display data;

a first digital-analog converter configured to output a first analog signal for the display data for conversion into a positive polarity;

a second digital-analog converter configured to output a second analog signal for the display data for conversion into a negative polarity;

a first switching circuit configured to transfer the display data of the latch to the first digital-analog converter or the second digital-analog converter, by the pre-polarity control information;

a first output buffer configured to output a first source signal of a positive polarity by driving the first analog signal;

a second output buffer configured to output a second source signal of a negative polarity by driving the second analog signal; and a second switching circuit configured to output one of the first source signal and the second source signal as a source signal to a selected channel, by normal polarity control information for polarity inversion by the unit of vertical 2 dots, wherein the pre-polarity control information and the normal polarity control information are received by being included in the polarity information.

9. A display driving apparatus comprising:

a timing controller configured to provide a data packet including control data including polarity information and display data; and a driving circuit configured to restore the display data and the polarity information from the data packet, and output source signals which correspond to the display data and whose polarities are controlled by the polarity information, wherein the polarity information includes normal polarity control information for polarity inversion by the unit of vertical 2 dots for one frame and pre-polarity control information for inverting polarities designated by the normal polarity control information, wherein one frame is divided into a plurality of blank periods by touch driving, wherein each blank period sequentially includes at least one pre dummy line and a plurality of active data lines, and wherein the driving circuit inverts, by the pre-polarity control information, polarities, designated by the normal polarity control information, of the source signals for the at least one pre dummy line of an odd-numbered blank period and the plurality of active data lines of an even-numbered blank period.

10. The display driving apparatus according to claim 9, wherein the driving circuit outputs a source signal by maintaining display data latched during a previous blank period in correspondence to the at least one pre dummy line.

11. The display driving apparatus according to claim 9, wherein the driving circuit converts the display data into a first analog signal of a positive polarity or a second analog signal of a negative polarity by first polarity inversion by the pre-polarity control information, and converts one of the first analog signal and the second analog signal into a source signal by second polarity inversion by the normal polarity control information.

12. The display driving apparatus according to claim 9, wherein the driving circuit controls, by the normal polarity control information, polarities of source signals for the plurality of active data lines of an odd-numbered blank period and a remaining pre dummy line of an even-numbered control information not selected by the pre-polarity control information.

13. The display driving apparatus according to claim 9, wherein each blank period sequentially includes a first pre dummy line and a second pre dummy line, and the driving circuit inverts, by the pre-polarity control information, polarities, designated by the normal polarity control information, of the source signals for the first pre dummy line and the second pre dummy line of an odd-numbered blank period and the plurality of active data lines of an even-numbered blank period.

14. The display driving apparatus according to claim 9, wherein each blank period sequentially includes a first pre dummy line and a second pre dummy line, and the driving circuit inverts, by the pre-polarity control information, polarities, designated by the normal polarity control information, of the source signals for the first pre dummy line of an odd-numbered blank period and the second pre dummy line and the plurality of active data lines of an even-numbered blank period.

15. The display driving apparatus according to claim 9, wherein the driving circuit comprises:

a restoration circuit configured to restore the data packet, and provide restoration data;

a data control unit configured to provide the pre-polarity control information, the normal polarity control information and the display data separated from the restoration data;

an output control circuit configured to receive the display data, maintain display data latched during a previous blank period in correspondence to the at least one pre dummy line, and output the source signals corresponding to the display data during the plurality of blank periods; and a polarity control circuit configured to receive the pre-polarity control information and the normal polarity control information, and invert, by the pre-polarity control information, polarities, designated by the normal polarity control information, of the source signals for the at least one pre dummy line of an odd-numbered blank period and the plurality of active data lines of an even-numbered blank period.

16. The display driving apparatus according to claim 15, wherein the driving circuit comprises:

a latch configured to latch the display data;

a first digital-analog converter configured to output a first analog signal for the display data for conversion into a positive polarity;

a second digital-analog converter configured to output a second analog signal for the display data for conversion into a negative polarity;

a first switching circuit configured to transfer the display data of the latch to the first digital-analog converter or the second digital-analog converter, by the pre-polarity control information;

a first output buffer configured to output a first source signal of a positive polarity by driving the first analog signal;

a second output buffer configured to output a second source signal of a negative polarity by driving the second analog signal; and a second switching circuit configured to output one of the first source signal and the second source signal as a source signal to a selected channel, by normal polarity control information for polarity inversion by the unit of vertical 2 dots.

* * * * *